US007840303B2

(12) United States Patent
Kayama

(10) Patent No.: US 7,840,303 B2
(45) Date of Patent: Nov. 23, 2010

(54) COATING WEIGHT CONTROL SYSTEM

(75) Inventor: Masahiro Kayama, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 669 days.

(21) Appl. No.: 11/828,487

(22) Filed: Jul. 26, 2007

(65) Prior Publication Data

US 2008/0026134 A1 Jan. 31, 2008

(30) Foreign Application Priority Data

Jul. 27, 2006 (JP) ..... 2006-204638

(51) Int. Cl.
*G06F 19/00* (2006.01)
*B05C 11/00* (2006.01)
*C23C 14/54* (2006.01)

(52) U.S. Cl. ..... 700/123; 118/699; 427/9

(58) Field of Classification Search ..... 700/123; 118/699; 427/9

See application file for complete search history.

(56) References Cited

U.S. PATENT DOCUMENTS 5,518,772 A * 5/1996 Andachi et al. ..... 427/349
2004/0050323 A1* 3/2004 Chae ..... 118/400

FOREIGN PATENT DOCUMENTS

JP 10-018014 1/1998

OTHER PUBLICATIONS

O.L.R. Jacobs. "Designing Feedback Controllers to Regulate Deposited Mass in Hot-Dip Galvaning". Control Eng. Practice 3.11 (1995): 1529-1542.*

Yoichi Sugita, et al.; Architecture and Training Algorithm of the Adjusting Neural Network for Accurate Model Tuning; Transaction of IEE of Japan, vol. 11-D; No. 4.

* cited by examiner

*Primary Examiner*—Ryan A Jarrett
(74) *Attorney, Agent, or Firm*—Antonelli, Terry, Stout & Kraus, LLP.

(57) ABSTRACT

An apparatus for performing a coating weight control calculation and an apparatus for generating an activation timing of each process in coating weight control are separately managed. A strip welding point pass event, a completion event of scan measurement of a steel strip in a width direction by a coating weight gauge, and a constant period event are related respectively to activation timings of preset control, feedback control and feedforward control respectively of a coating weight. In a coating weight control apparatus and method, the activation timing generation apparatus is equipped with a function of calculating a timing of changing a pressure reference avoiding insufficient coating in accordance with response characteristics of a pressure as an operation terminal, and if a target coating weight is changed from thin coating to thick coating, generating a preset control activation reference in accordance with the calculation result.

6 Claims, 12 Drawing Sheets

FIG.5

| | | |
|---|---|---|
| HEADER | 1 | 501 TRANSMISSION INFORMATION |
| TARGET COATING WEIGHT (TOP) | 150 (g/m²) | |
| TARGET COATING WEIGHT (BOTTOM) | 150 (g/m²) | |
| ACTUAL COATING WEIGHT (TOP) | 161 (g/m²) | |
| ACTUAL COATING WEIGHT (BOTTOM) | 158 (g/m²) | |
| SET NOZZLE PRESSURE (TOP) | 30.0 (kPa) | |
| SET NOZZLE PRESSURE (BOTTOM) | 30.0 (kPa) | |
| ACTUAL NOZZLE PRESSURE (TOP) | 29.8 (kPa) | |
| ACTUAL NOZZLE PRESSURE (BOTTOM) | 28.9 (kPa) | |
| SET NOZZLE GAP (TOP) | 12.0 (mm) | |
| SET NOZZLE GAP (BOTTOM) | 12.0 (mm) | |
| ACTUAL NOZZLE GAP (TOP) | 12.0 (mm) | |
| ACTUAL NOZZLE GAP (BOTTOM) | 11.9 (mm) | |
| LINE SPEED | 120 (mpm) | |
| DISTANT OF NOZZLE - WELDING POINT | 2506 ( × 100mm) | |
| | ⋮ | |

FIG.6

| | | |
|---|---|---|
| SET NOZZLE PRESSURE (TOP) | 35.0 (kPa) | 601 RECEPTION INFORMATION |
| SET NOZZLE PRESSURE (BOTTOM) | 35.0 (kPa) | |

107 ADAPTIVE TABLE

| | ~50g/m² | 50~60 | 60~70 | | 200~g/m² |
|---|---|---|---|---|---|
| ~60mpm | | | | -------- | |
| 60~70 | | | | -------- | |
| 70~80 | | ΔWij | | -------- | |
| 80~90 | | | | -------- | |
| 90~100 | | | | -------- | |
| ⋮ | ⋮ | ⋮ | ⋮ | ⋮ | ⋮ |
| 180~mpm | | | | -------- | |

COATING WEIGHT CONTROL SYSTEM

BACKGROUND OF THE INVENTION

The present invention relates to a plating amount or coating weight control system for process lines of a steel strip plant, capable of improving a response performance of coating weight control. The present invention relates also to a coating weight control method capable of improving a control accuracy to prevent defective products to be caused by thin coating.

As a conventional coating weight control method, for example, JP-A-10-18014 discloses a method of operating various control units necessary for coating control in a coating weight control system.

SUMMARY OF THE INVENTION

The method disclosed in JP-A-10-18014 is, however, associated with the following problems because the method does not consider that a coating weight control unit is processed separately from a process of generating an activation timing for the coating weight control unit.

The coating weight control unit has a coating weight prediction physical model and calculates a control reference by solving the model, resulting in a complicated sequence and a long calculation time. In contrast, although the process of generating an activation timing for the coating weight control is a general sequence process so that calculation thereof is simple, a high response performance is required. Therefore, if the coating weight control unit is processed mixedly with the activation timing generation process for the coating weight control unit, a response of the activation timing generation process lowers during operation of the coating weight control unit, so that a control precision of a coating weight is lowered.

The coating weight control is characterized in that although a slightly larger coating weight does not pose a problem of a product quality, a smaller coating weight may result in defective product quality. A response performance of a nozzle pressure as one of operation terminals for coating weight control is generally 10 to 20 seconds. The method disclosed in JP-A-10-18014 does not consider this, but a pressure control reference is issued at the same timing. As a result, when a coating weight target value changes from thin coating to thick coating, a coating weight becomes smaller than the target coating weight at the timing a pressure response cannot be established, resulting in a defective product.

In addition, the coating weight control unit has high reusability, whereas the process of generating an activation timing for the coating weight control unit is required to change and modify its specifications, because the activation conditions vary with the coating system and the configuration of process lines for processing transported steel strip. From the viewpoint of software productivity, therefore, the coating weight control unit should be processed separately from the activation timing generation process. However, any proper interface is not disclosed between the coating weight control unit and the activation timing generation process.

An issue to be solved by the present invention resides in providing a system configuration properly separating and cooperatively operating the coating weight control unit and the coating weight control unit activation timing generation process, and in providing a proper interface between the coating weight control unit and the coating weight control unit activation timing generation process, by paying attention to the type of a coating weight control unit. Another issue of the present invention resides in realizing coating weight control capable of preventing a coating weight from being lowered from a target value even at a timing when a coating target value is changed, by optimizing the coating weight control unit activation timing generation process.

In order to solve the above-described issues, a coating weight control system of the present invention has a coating weight control apparatus for performing coating weight control calculations and a device control apparatus for controlling devices in process lines and a motion of a steel strip, respectively connected by a network. The device control apparatus is equipped with a transmission information editing unit for collecting information necessary for coating weight control from a control object and editing the information as a communication message and a transmission timing generation unit for generating a timing when the message is transmitted to the coating weight control apparatus.

The coating weight control apparatus is equipped with a control function unit necessary for coating weight control including preset control, feedback control and the like, and a task activation function unit for selectively activating a plurality of control units by analyzing a communication message and using a reception of the communication message from the device control apparatus as an activation timing for coating weight control.

The transmission timing generation unit of the device control apparatus is provided with a function of comparing target coating weights of preceding and succeeding strips, and if the target coating weight changes from thin coating to thick coating, generating an activation timing for preset control by considering a response of a pressure.

The activation timings supplied from the device control apparatus include three timings, a steel strip welding point pass event, a completion event of scan measurement of a steel strip in a width direction by a coating weight gauge, and a constant period, which are related to activation timings for preset control, feedback control and feedforward control respectively of a coating weight to be executed by the coating weight control apparatus, respectively.

The priority order of coating weight control is set to the order of the preset control, feedforward control and feedback control, in correspondence with the priority order of the steel strip welding point pass event, constant period and coating weight measurement completion event, respectively in an activation timing generation process of the device control apparatus.

The preset control timing is generated advancing a target coating weight change timing by considering the response performance of a pressure as an operation terminal.

According to the present invention, the coating weight control function unit and a process of generating an activation timing for the coating weight control function unit are separately realized by the coating weight control apparatus and device control apparatus. It is therefore possible to solve the problem that a response of an activation timing generation process for the coating weight control function unit is lowered during coating weight control, and to realize high precision coating weight control.

The activation timings supplied from the device control apparatus are related to activation timings for the preset control, feedback control and feedforward control respectively of a coating weight to be executed by the coating weight control apparatus. The priority order of the coating weight control can be properly set to the order of the preset control, feedforward control and feedback control.

By generating a preset control timing advancing the target coating weight change timing, coating weight control preventing the coating thickness from becoming thinner than a target value can be realized even when a target coating weight changes from thin coating to thick coating, resulting in a reduction in defective quality products.

Even if there is a change in the apparatus configuration in process lines or a motion style of a steel strip and the generation logic of coating weight control changes, it is possible to deal with this change by changing software of the device control apparatus, and it is not necessary to change software of the coating weight control apparatus. It is therefore possible to improve reusability of the coating weight control unit and reduce the number of system configuration processes.

Other objects, features and advantages of the invention will become apparent from the following description of the embodiments of the invention taken in conjunction with the accompanying drawings.

BRIEF DESCRIPTION OF THE DRAWINGS

FIG. 5 an illustrative diagram showing an example of a message to be transmitted by a transmission unit.

FIG. 6 is an illustrative diagram showing an example of a message to be received by a reception unit.

DESCRIPTION OF THE EMBODIMENTS

A coating weight control system of the present invention allows high precision of a coating weight and suppression of defective quality, for the coating weight control in steel strip process lines. Reusability of coating weight control software can be improved so that a high precision coating weight control system can be configured at low cost.

First Embodiment

Figure 1:
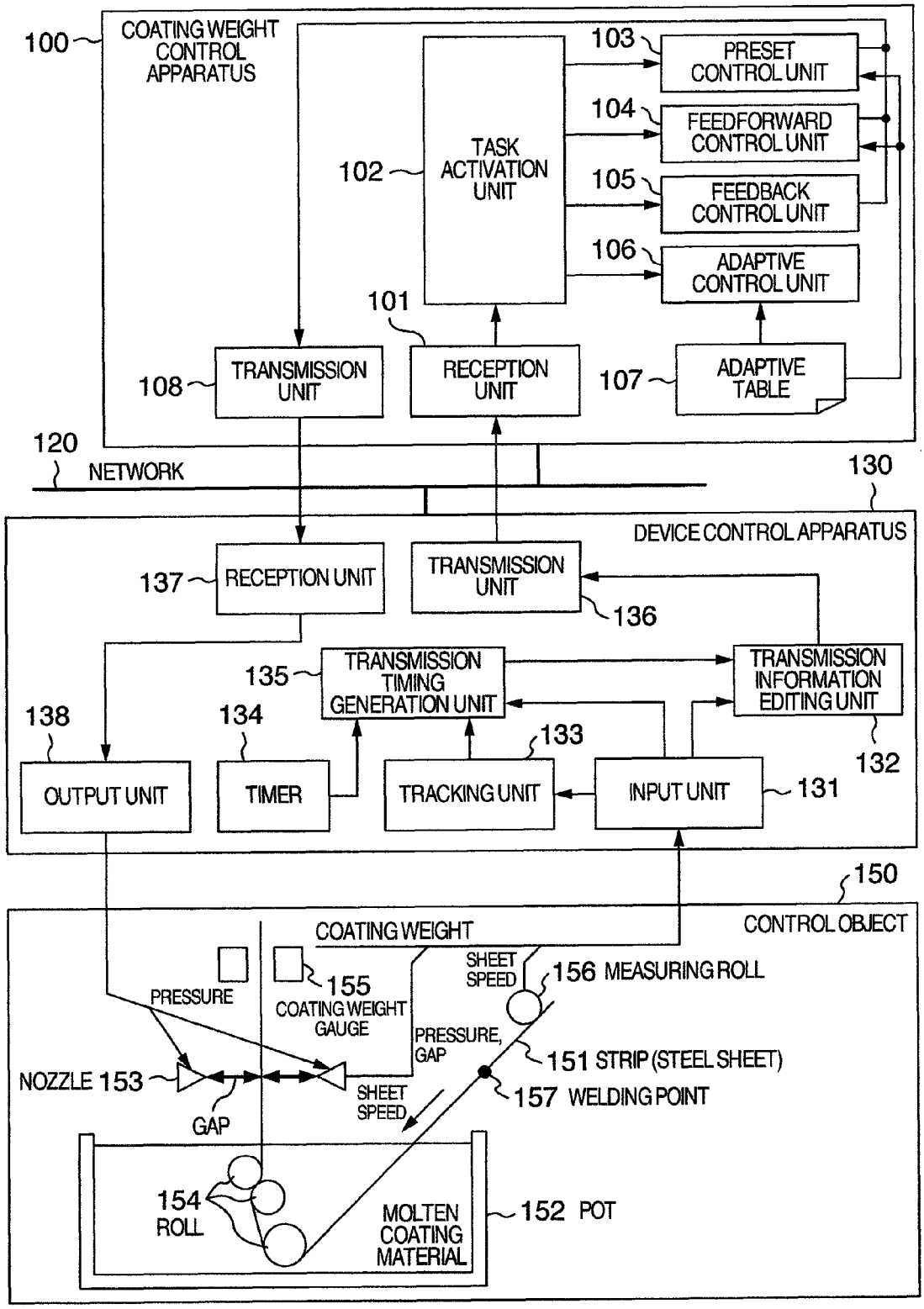
FIG. 1 is a diagram showing the configuration of a coating weight control system according to a first embodiment of the present invention.

FIG. 1 shows the configuration of a coating weight control system according to the first embodiment of the present invention. A coating weight control apparatus 100 controls via a device control apparatus 130 a control object 150 which is a coating weight control plant, to attach a desired thickness of coating to a strip (steel strip) 151. The device control apparatus 130 is usually a programmable controller which transmits a signal fetched from the control object 150 to the coating weight control apparatus 100, and outputs a control reference as a calculation result by the coating weight control apparatus 100 to the control object 150. The device control apparatus 130 controls a speed of the strip 151 and the operations of various devices included in the control object.

The control object 150 will be described first. Molten coating material is pooled in a pot 152 of the control object 150, and the continuously transported strip 151 is supported by various rolls 154. In this state, the strip 151 transported at some plate speed is once immersed into the molten coating material, and just when the strip is pulled out of the pot, gas at a high pressure is blown from a nozzle 153 to the strip to strip off unnecessary molten coating material and control the coating weight to a desired value. A coating weight attached to the strip 151 is generally determined from a speed (sheet speed) of the strip 151, a pressure of gas blown from the nozzle 153, and a distance between the nozzle 153 and strip 151 at a nozzle blowing position. This relation is represented by, for example, a control model expressed by a formula (1):

$$\ln(W)=a0+a1\cdot\ln(P)+a2\cdot\ln(V)+a3\cdot\ln(D) \quad (1)$$

where W is a coating weight, P is a nozzle gas pressure, V is a line speed, D is a nozzle gap, and a1 to a3 are constants.

Consecutive strips are coupled by welding, and a welding point 157 is usually a point where a coating weight target value is changed. An actual coating weight is measured with a coating weight gauge 155.

Figure 2:
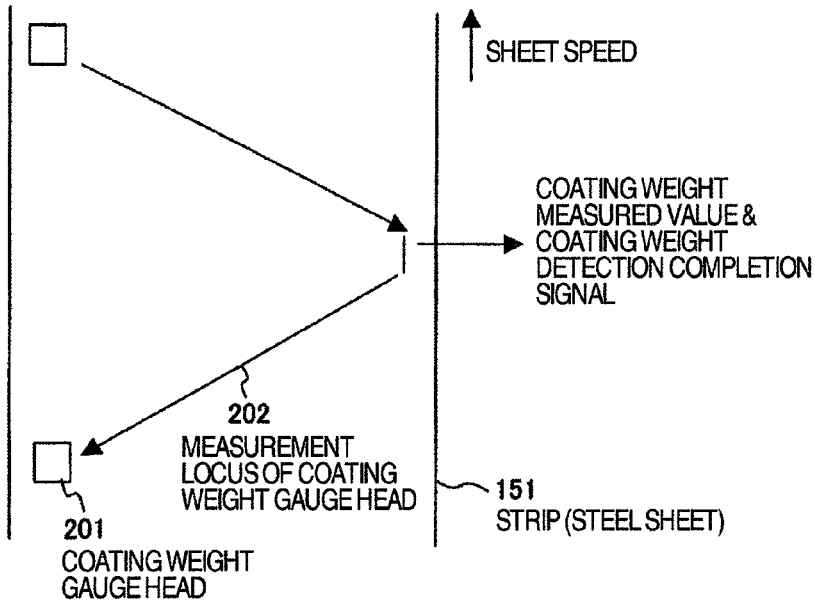
FIG. 2 is a diagram illustrating a measurement method of a coating weight gauge.

FIG. 2 is a schematic diagram showing a typical coating weight measuring mode of the coating weight gauge 155. A head 201 of the coating weight gauge 155 measures a coating weight by reciprocally moving along the width direction of the strip 151. Since the strip 151 moves along the longitudinal direction, a measurement locus 202 of the coating weight gauge head 201 has a shape traversing obliquely the strip 151 as shown in FIG. 2. After completion of one traverse, the coating weight gauge 201 outputs a measured value of the coating weight and a coating weight detection completion signal representative of the completion of traverse. In the example shown in FIG. 1, a plate speed is measured with a measuring roll 156.

The device control apparatus 130 shown in FIG. 1 has: an input unit 131 for fetching signals from the control object; a transmission information editing unit 132 for editing and generating information to be transmitted to the coating weight control apparatus 100, from the fetched input signals; and a tracking unit 133 for predicting a position of the welding point 157 from the fetched input signals. The device control apparatus further has: a transmission timing generation unit 135 for generating a timing when the transmission information editing unit 132 transmits information, in accordance with a combination of outputs from the input unit 131, tracking unit 133 and a timer 134; and a transmission unit 136 for transmitting an output of the transmission information editing unit 132 to the coating weight control apparatus 100. The device control apparatus further has a reception unit 137 for receiving a signal transmitted from the coating weight control apparatus 100 and an output unit 138 for outputting a received signal to the control object 150. In the following, the structure of the device control apparatus 130 will be described in detail.

For coating control, the device control apparatus 130 fetches via the input unit 131 at least a coating weight measured value W and coating weight detection completion signal which are outputs of the coating weight gauge 155, a sheet speed V, a nozzle pressure P and a gap D, and outputs W, V, P and D to the transmission unit editing unit 132, the coating weight detection completion signal to the transmission timing generation unit 135, and the sheet speed V to the tracking unit 133. The tracking unit 133 calculates a motion distance of the strip 151 by integrating the sheet speed to predict the position of the welding point 157.

Figure 3:
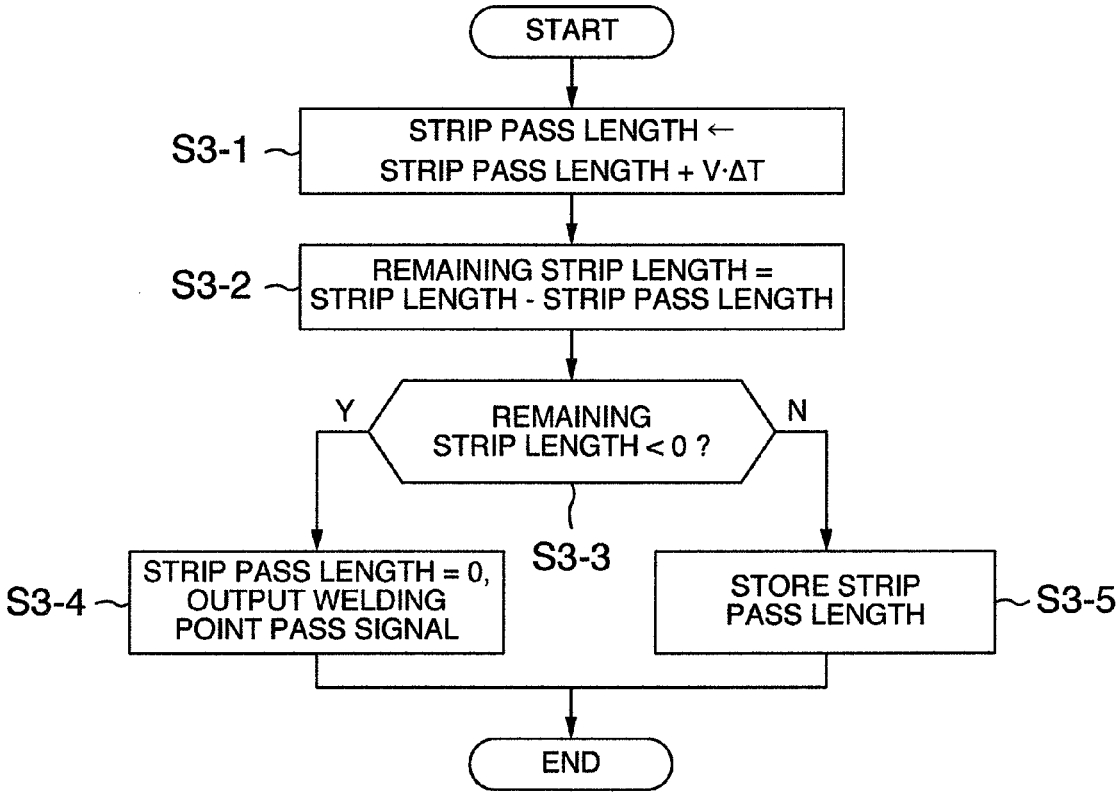
FIG. 3 is a flow chart illustrating the operation of a tracking unit.

FIG. 3 illustrate the operation to be executed by the tracking unit 133. A strip pass length indicates a distance of a strip position passing the position of the nozzle 153 from a point where the target coating weight was changed. At S3-1, this strip pass length is updated. Namely, the present strip pass length is calculated by adding the present strip pass length to a value ($V \times \Delta T$) of the sheet speed multiplied by $\Delta T$, wherein $\Delta T$ is a calculation period of a tracking period. A strip length is a length from the welding point of the present strip to the welding point of the next strip. At S3-2, a remaining strip length is calculated by subtracting the strip pass length from the strip length. The remaining strip length corresponds to a distance to the next welding point 157. It is judged at S3-3 whether the remaining strip length is shorter than "0". If smaller than "0", the strip pass length is set to "0" at S3-4, and a welding point pass signal is output. If the remaining strip length is still larger than "0", the updated strip pass length is stored as a new strip pass length at S3-5.

Figure 4:
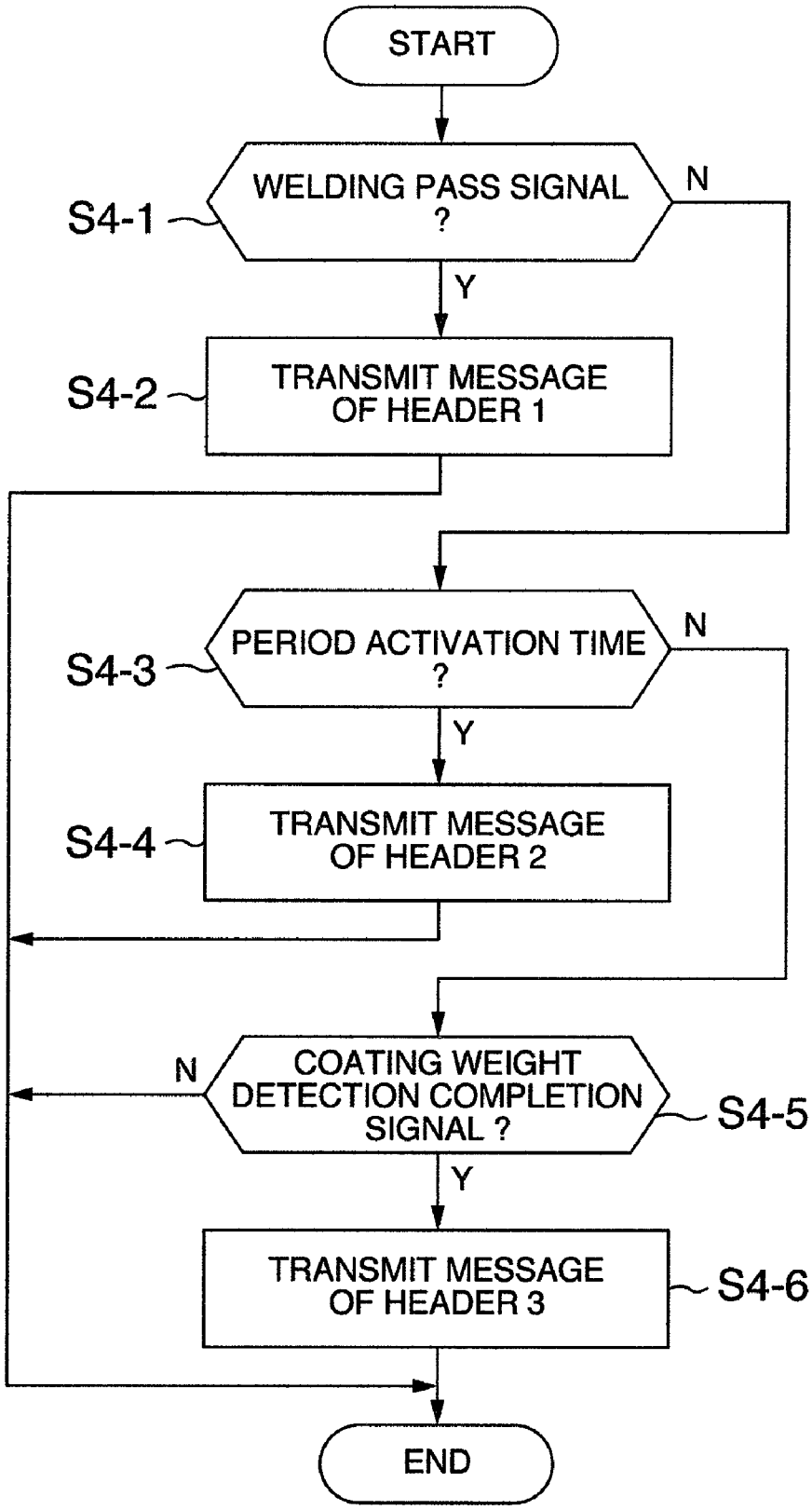
FIG. 4 is a flow chart illustrating the operation of a transmission timing generation unit.

FIG. 4 illustrates the operation to be executed by the transmission timing generation unit 135. The transmission timing generation unit 135 is input with the coating weight detection completion signal from the input unit 131, the welding point pass signal from the tracking unit 133, and a constant period signal from the timer 134. By using these inputs, the transmission timing generation unit outputs a signal for setting a type and timing of information to be transmitted from the transmission information editing unit 132 to the coating weight control apparatus 100. It is judged at S4-1 whether there is a welding point pass signal sent from the tracking unit 133. If the welding point pass signal is input, a message of a header 1 is transmitted to the coating weight control apparatus 100 at S4-2.

In this embodiment, as shown in FIG. 4, a priority order of the activation timing generation process at the device control apparatus 130 is set in the order of a welding point pass event of the steel strip, a constant period, and a coating weight measurement completion event. In this manner, the priority order of coating weight control is set properly to the order of preset control, feedforward control and feedback control.

FIG. 5 shows an example of the structure of a message to be transmitted by the coating weight control apparatus 100. Transmission information 501 indicates the contents of a message. A numerical number in a header means an activation parameter for a plurality of coating weight control units equipped in the coating weight control apparatus 100. The coating weight control apparatus 100 analyzes the numerical number to determine which control unit is to be activated. The header 1 means activation of preset control of coating weight control if the welding point pass signal is input. Data necessary for coating weight control is stored in the transmission information 501 in the order shown in FIG. 5, and transmitted. Set values are reference values supplied from the device control apparatus 130 to the control object 150, and actual values are values actually measured at the control object 150. A distance of nozzle-welding point indicates a length of the strip 151 from the nozzle 153 to the welding point 157.

If the welding point pass signal is not input, it is judged at S4-3 in FIG. 4 from a signal output from the timer 134 whether it is an activation time of the period. The period is assumed to be about 500 ms to 1 s. If it is the activation time, a message of a header 2 is transmitted to the coating weight control apparatus 100 at S4-4. If it is not the time of period activation, it is judged at S4-5 whether the coating weight detection completion signal is fetched from the input unit. If fetched, a massage of a header 3 is transmitted to the coating weight control apparatus 100 at S4-6.

The reception unit 137 receives a reference for coating weight control from the coating weight control apparatus 100. FIG. 6 shows an example of reception information. In this embodiment, an example of coating weight control will be described by using a nozzle pressure as an operation terminal. Reception information 601 indicates a reception of control results that the nozzle pressures are set to 35.0 kPa both at the top and bottom. In addition to the nozzle pressure, a nozzle gap may be used as an operation terminal. It may be considered that both the nozzle pressure and nozzle gap are used as the operation terminals.

Next, with reference to FIG. 1, description will be made on the structure of the coating weight control apparatus 100. The coating weight control apparatus 100 is equipped with a preset control unit 103 for calculating a reference value of an operation terminal so as to realize a new target value when a target coating weight is changed. If a gap changes or a strip speed changes while the nozzle 153 is operated, this change influence is compensated. Namely, the coating weight control apparatus is equipped with a feedforward control unit 104 for calculating a reference value at the operation terminal and a feedback control unit 105 for calculating a reference value at the operation terminal in order to compensate for a difference between the target coating weight and a detection value from the coating weight gauge 155. An adaptive control unit 106 is also equipped for updating an adaptive table 107 for storing a shift of the control model represented by the formula (1) from an actual situation. The coating weight control apparatus is also equipped with a reception unit 101 for receiving a message from the device control apparatus 130, a task activation unit 102 for analyzing the message received at the reception unit 101 and judging which control unit is to be activated, and a transmission unit 108 for fetching reference values at the operation terminals calculated by the control units 103 to 105 and outputting the reference values to the device control apparatus 130.

Figure 7:
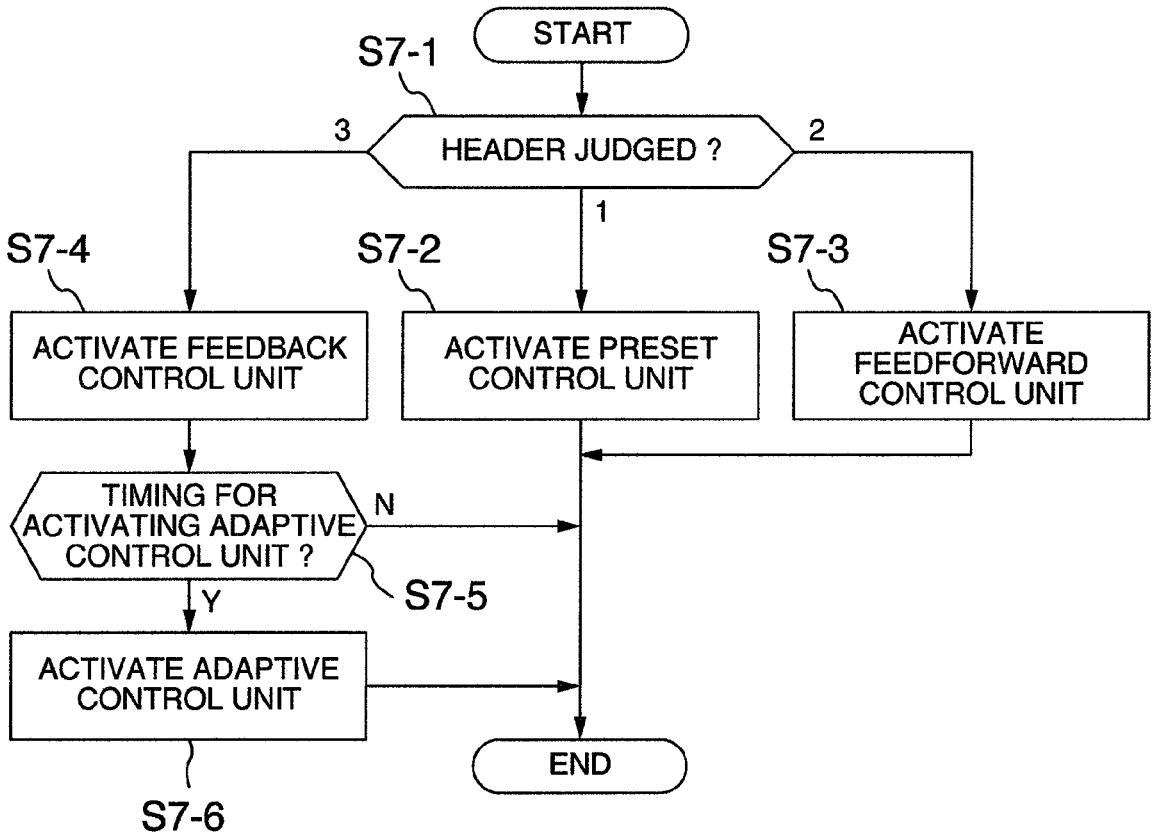
FIG. 7 is a flow chart illustrating the operation of a task activation unit.

FIG. 7 illustrates the operation to be executed by the task activation unit 102. Upon reception of the transmission information 501 in the form of a message from the reception unit 101, the header is analyzed at S7-1. If the header is "1", the preset control is activated at S7-2. If the header is "2", the feedforward control is activated at S7-3. If the header is "3", the feedback control is activated at S7-4. After the calculation completion of the feedback control, it is judged at S7-5 whether it is a timing when the adaptive control unit is activated. If it is the timing, the adaptive control unit is activated at S7-6.

Figure 8:
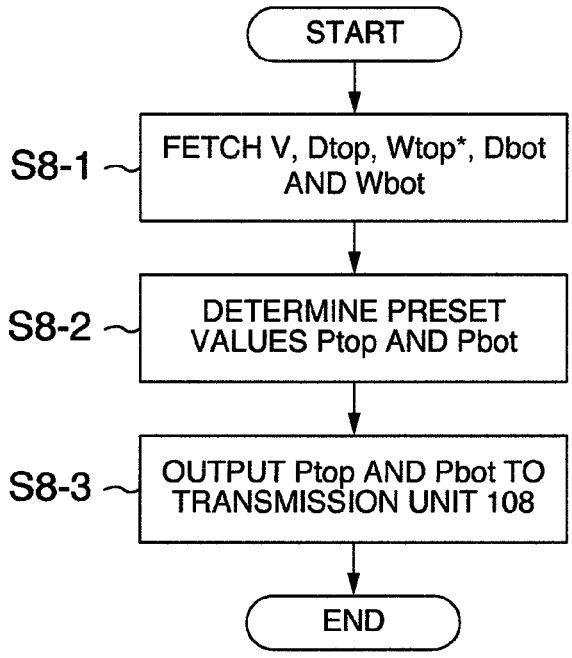
FIG. 8 is a flow chart illustrating the operation of a preset control unit.

FIG. 8 illustrates the operation to be executed by the preset control unit 103. Necessary information including a strip speed V, an actual nozzle gap (top) Dtop, a target coating weight (top) Wtop*, an actual nozzle gap (bottom) Dbot and a target coating weight (bottom) Wbot* is fetched from the transmission information 501 at S8-1. These values are substituted into a formula (2) for each of the top and bottom to obtain In(P) at S8-2:

$$\ln(P)=\{\ln(W)-(a0+a2\cdot\ln(V)+a3\cdot\ln(D))/a1]\} \quad (2)$$

After In(P) is obtained, In(P) is changed to a nozzle pressure P to determine preset values Ptop and Pbot. Ptop and Pbot are output to the transmission unit 108 at S8-3. If the target coating weight and nozzle pressure are the same for both the top and bottom, an average D of Dtop and Dbot may be used for the calculation and the obtained P may be used as the preset values Ptop and Pbot, at S8-2.

Figure 9:
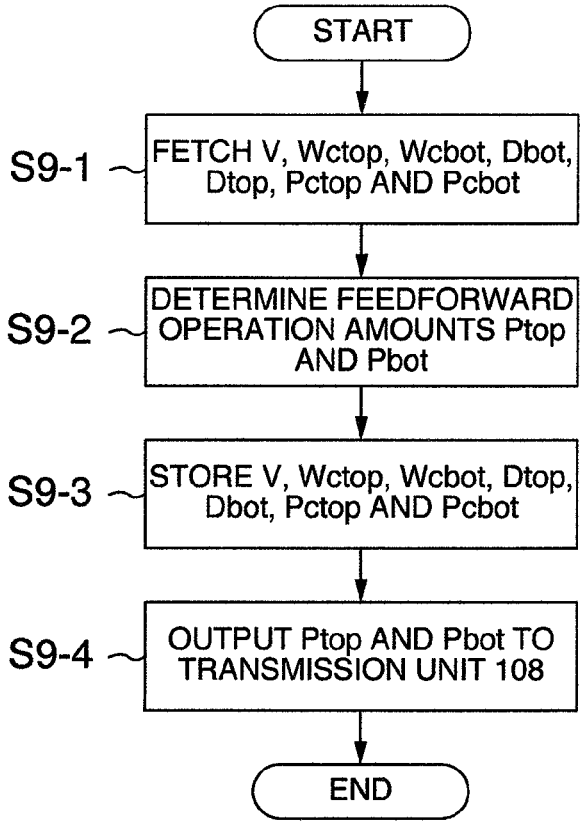
FIG. 9 is a flow chart illustrating the operation of a feed-forward control unit.

FIG. 9 illustrates the operation to be executed by the feedforward control unit 104. Necessary information including a strip speed V, an actual coating weight (top) Wctop, an actual coating weight (bottom) Wcbot, an actual nozzle gap (top) Dtop, an actual nozzle gap (bottom) Dbot, a set nozzle pressure (top) Pctop and a set nozzle pressure (bottom) Pcbot is fetched from the transmission information 501 at S9-1. These values are substituted into formulas (3) for each of the top and bottom to obtain control results of the nozzle pressures for the top and bottom at S9-2:

$$\left.\begin{aligned} Ptop &= Pctop + P1top - P2top \\ Pbot &= Pcbot + P1bot - P2bot \end{aligned}\right\} \quad (3)$$

P1top is a value converted into a nozzle pressure P by obtaining ln(P) by substituting the strip speed V, actual coating weight (top) Wctop and actual nozzle gap (top) Dtop into the formula (2). P2top is a nozzle pressure calculated by using these values previously stored at S9-3.

Therefore, if there is a difference between the previous values and the presently fetched strip speed V, actual coating weight (top) Wctop and actual nozzle gap (top) Dtop, there is a difference between P1top and P2top. Ptop has a value obtained from Pctop compensated for a change in the strip speed V, actual coating weight (top) Wctop and actual nozzle gap (top) Dtop. If all the strip speed V, actual coating weight (top) Wctop and actual nozzle gap (top) Dtop are the same for the present and previous values, Ptop and Pctop take the same value. Similar calculations are performed also for Pbot. The strip speed V, actual coating weight (top) Wctop, actual coating weight (bottom) Wcbot, actual nozzle gap (top) Dtop, actual nozzle gap (bottom) Dbot, set nozzle pressure (top) Pctop and set nozzle pressure (bottom) Pcbot presently fetched are stored at S9-3 to be used for the next calculations. The calculated Ptop and Pbot are output to the transmission unit 108 at S9-4. If the target coating weight and nozzle pressure are the same for both the top and bottom, an average D of Dtop and Dbot may be used for the calculation and the obtained P may be used as feedforward control calculation values Ptop and Pbot, at S9-2.

Figure 10:
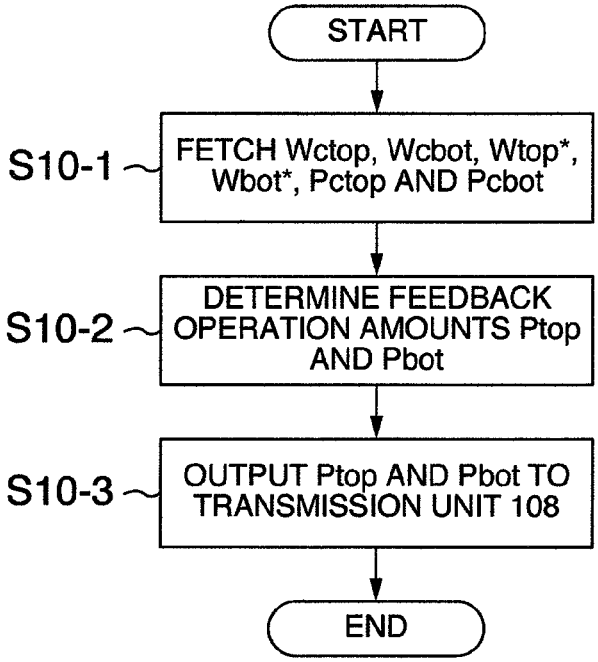
FIG. 10 is a flow chart illustrating the operation of a feed-back control unit.

FIG. 10 illustrates the operation to be executed by the feedback control unit 105. Necessary information including an actual coating weight (top) Wctop, an actual coating weight (bottom) Wcbot, a target coating weight (top) Wtop*, a target coating weight (bottom) Wbot*, a presently set nozzle pressure (top) Pctop and a presently set nozzle pressure (bottom) Pcbot is fetched from the transmission information 501 at S10-1. Formulas (4) are calculated for each of the top and bottom at S10-2:

$$Ptop = Pctop + G\cdot(Pctop/Wctop)\cdot(Wctop - Wtop^*)$$

$$Pbot = Pcbot + G\cdot(Pcbot/Wcbot)\cdot(Wcbot - Wbot^*) \quad (4)$$

G is a feedback control gain. By using the formulas (4), control results Ptop and Pbot of the nozzle pressures of the top and bottom are calculated as the feedback control amounts. Ptop and Pbot are output to the transmission unit 108 at S10-3.

Figures 11, 12:
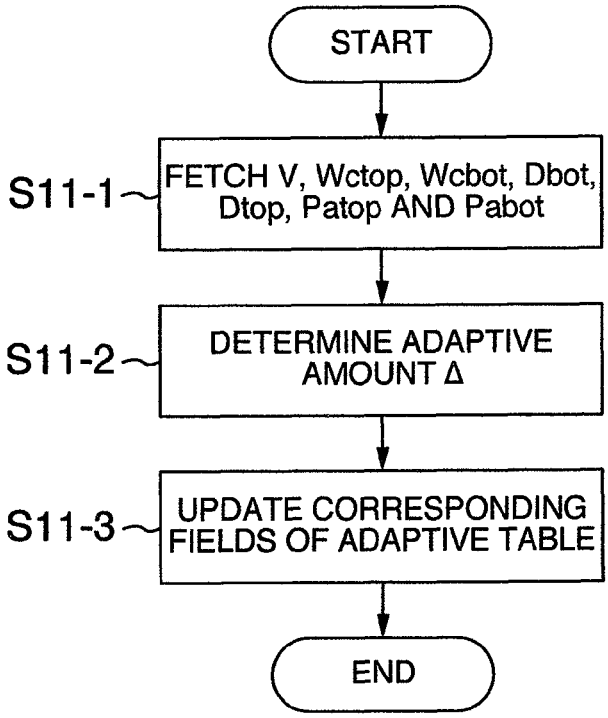
FIG. 11 is a flow chart illustrating the operation of an adaptive control unit.
FIG. 12 is an illustrative diagram showing an example of an adaptive table.

FIG. 11 illustrates the operation to be executed by the adaptive unit 106. A strip speed V, an actual coating weight (top) Wctop, an actual coating weight (bottom) Wcbot, an actual nozzle gap (top) Dtop, an actual nozzle gap (bottom) Dbot, an actual nozzle pressure (top) Patop and an actual nozzle pressure (bottom) Pabot are fetched from the transmission information 501 at S11-1. An adaptive degree Δ is calculated from a formula (5) at S11-2:

$$\Delta = (Wctop + Wcbot)/2 - Wobs \quad (5)$$

where Wobs is defined by:

$$\ln(Wobs) = a0 + a1\cdot\ln\{(Patop + Pabot)/2\} + a2\cdot\ln(V) + a3\cdot\ln\{(Dtop + Dbot)/2\}$$

Corresponding fields of the adaptive table 107 are updated at S11-3.

FIG. 12 shows an example of the adaptive table. The adaptive table 107 is partitioned by a coating weight and a strip speed. Namely, in this example, the column of the table is divided into fields at every coating weight of 10 g/m$^2$, and the row is divided into fields at every strip speed of 10 mpm.

The update fields of the table are determined by the values of (Wctop+Wcbot)/2 for the coating weight and V for the strip speed. Specific updating at S11-3 is performed by a formula (6):

$$(\Delta Wij)_n = \gamma\cdot(\Delta Wij)_{n-1} + (1-\gamma)\cdot\Delta \quad (6)$$

where γ is a distribution coefficient.

An adaptive value $(Aij)_{n-1}$ stored in an update field is added to Δ calculated by the formula (5) and weighted by a constant distribution coefficient γ to update $(Aij)_{n-1}$ to $(Aij)_n$. Adaptive results are used by the preset control and feedforward control. Namely, when the nozzle pressures are calculated by the formulas (2) and (3), the calculation formula is modified to a formula (7) to conduct the preset control and feedforward control reflecting the adaptive results;

$$\ln(P) = \{\ln(W - \Delta Wij) - (a0 + a2\cdot\ln(V) + a3\cdot\ln(D))/a1\} \quad (7)$$

ΔWij corresponds to an error of the control model. The formula (7) compensates for a model error so that reference values for the preset control and feedforward control become adaptive with the present plant state so that a control precision can be improved.

Figure 13:
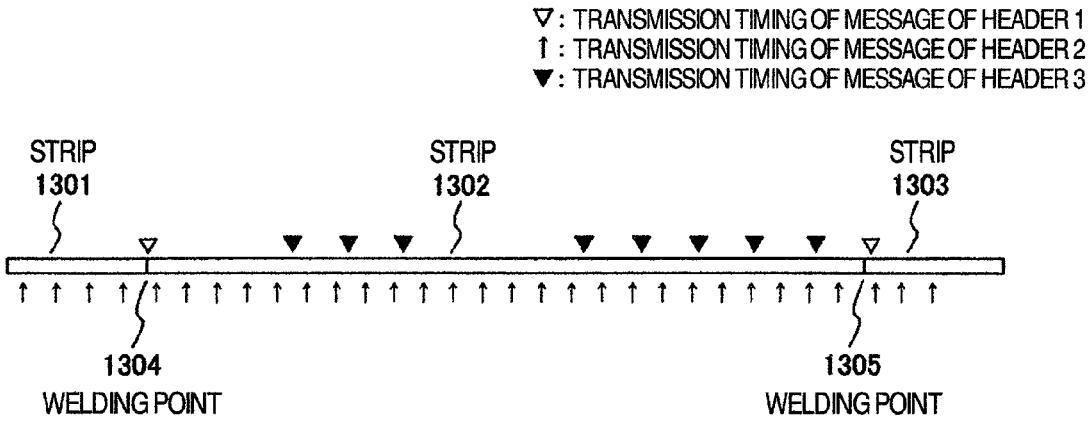
FIG. 13 is a timing chart showing transmission timings of messages to be output by a device control apparatus.

FIG. 13 shows an example of a timing chart illustrating transmission of a message to the coating weight control apparatus 100 from the device control apparatus 130. Strips 1301 to 1303 are connected at welding points 1304 and 1305. In FIG. 13, an inverted white triangle (_) indicates a transmission timing of the transmission information 501 of the header 1, ↑ indicates a transmission timing of the transmission information 501 of the header 2, and an inverted black triangle indicates a transmission timing of the transmission information 501 of the header 3. A message of the header 1 is transmitted at a timing when the welding point 1304, 1305 passes the nozzle 153, and a message of the header 2 is transmitted at a constant period. A message of the header 3 is transmitted at a timing when the device control apparatus 130 receives the coating weight detection completion signal from the coating weight gauge 155.

It can be considered that the message of the header 3 is transmitted at a timing during the period from when the strip 151 passes the nozzle 153 to when the coating weight gauge 155 measures a coating weight, only if the speed V, nozzle pressure P and nozzle gap D do not change. FIG. 13 shows an example of this case. The coating weight detected in this case is a stable coating weight corresponding to the present operation amount because the control state and operation amount do not change. Therefore, by performing the feedback control only in this case, the feedback control can be stabilized. Whether the detected coating weight is the stable coating weight can be easily judged by monitoring whether the speed V, nozzle pressure P and nozzle D do not change while the tracking amount of the tracking unit 133 changes from the nozzle 153 to the coating weight gauge 155.

Figure 14:
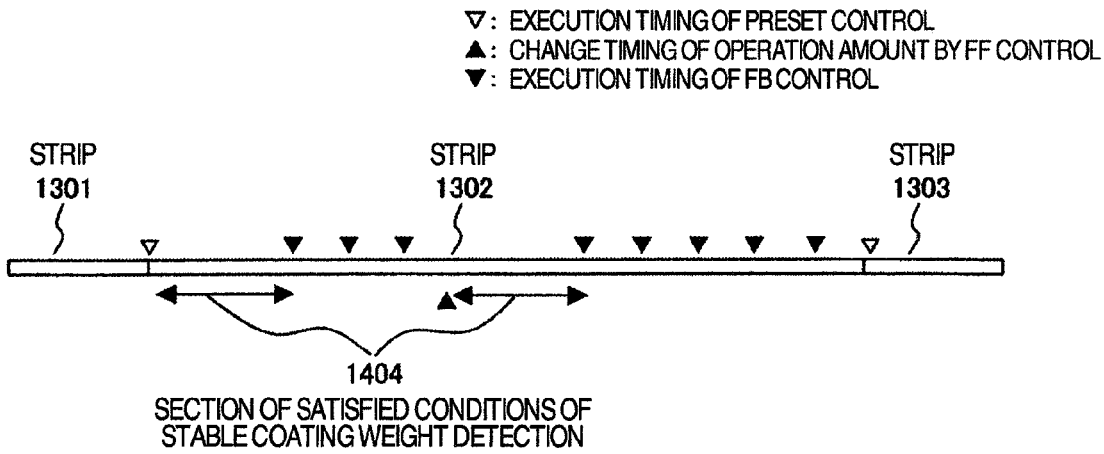
FIG. 14 is a timing chart showing execution timings of control units to be made by a coating weight control apparatus.

FIG. 14 shows an example of a timing chart when the coating weight control apparatus 100 executes each control. In the example shown in FIG. 14, a preset control (inverted white triangle), a feedforward control (black triangle) and a feedback control (inverted black triangle) are executed in response to the activation signals from the device control apparatus 130 shown in FIG. 13.

More specifically, the preset control is executed at a change point between strips and at a timing when the message of the header 1 is received. The feedforward control is executed at a timing when the message of the header 2 is received. Only if P1 and P2 in the formulas (3) are different, the operation amount is changed to make effective the control. The operation amount is substantially changed at a timing when the sheet speed or nozzle gap changes, e.g, at a timing shown in FIG. 14. The feedback control is executed at a timing when the message of the header 3 is received. In this example, since the stable coating weight is not detected immediately after the preset control and feedforward control, the feedback control is not executed.

Second Embodiment

In the first embodiment, the feedforward control is executed at a timing synchronous with the period signal supplied from the device control apparatus 130. The feedforward control may substantially be executed at a timing when the sheet speed or nozzle gap is changed. In the example of the second embodiment, an activation signal for the feedforward control is generated by detecting a change in the sheet speed or nozzle gap.

Figure 15:
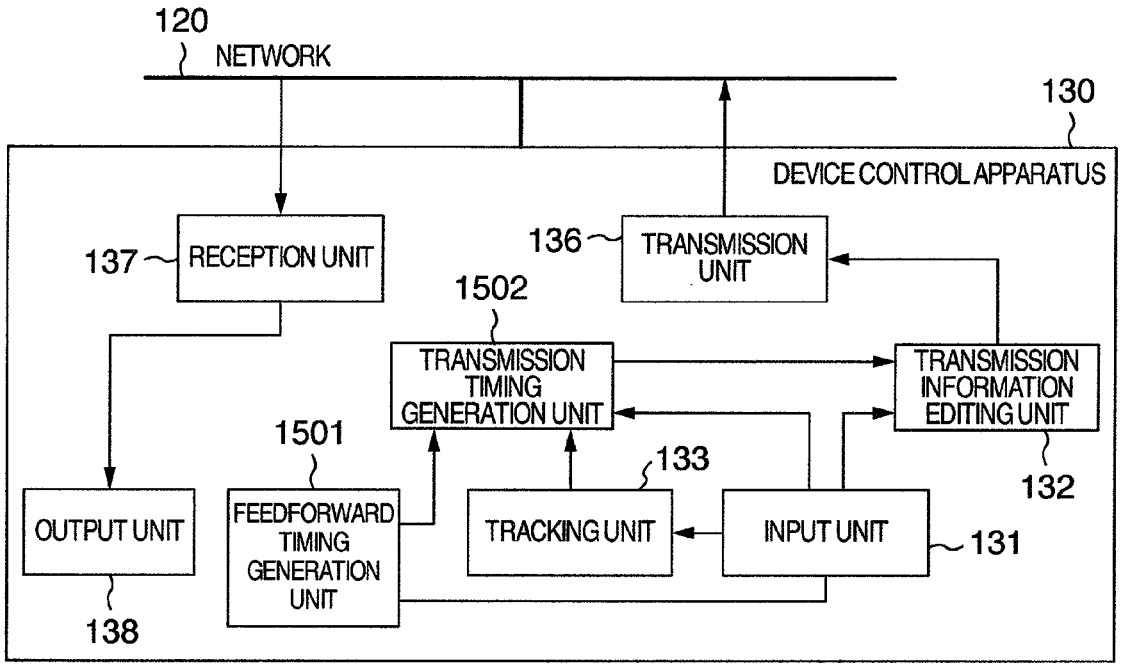
FIG. 15 is a diagram showing the structure of a device control apparatus according to a second embodiment of the present invention.

FIG. 15 shows the structure of a device control apparatus according to the second embodiment. A feedforward timing generation unit 1501 is periodically activated at a proper interval, and when a change in the strip speed or nozzle gap is detected, notifies a transmission timing generation unit 1502 of a transmission timing of the message of the header 2.

Figure 16:
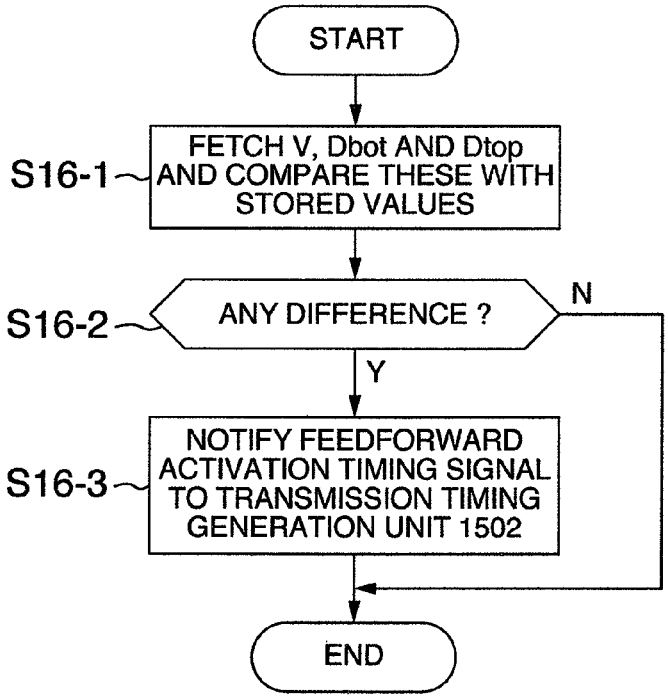
FIG. 16 is a flow chart illustrating the operation of a feed-forward timing generation unit according to the second embodiment.

FIG. 16 illustrates the operation to be executed by the feedforward timing generation unit 1501. The strip speed V and nozzle gaps Dtop and Dbot are fetched at S16-1, and compared with those values already stored. It is checked at S16-2 whether there is any difference. If there is any difference, a feedforward activation timing signal is notified to the transmission timing generation unit 1502 at S16-3, whereas if there is no difference, the process is terminated without notification.

Figure 17:
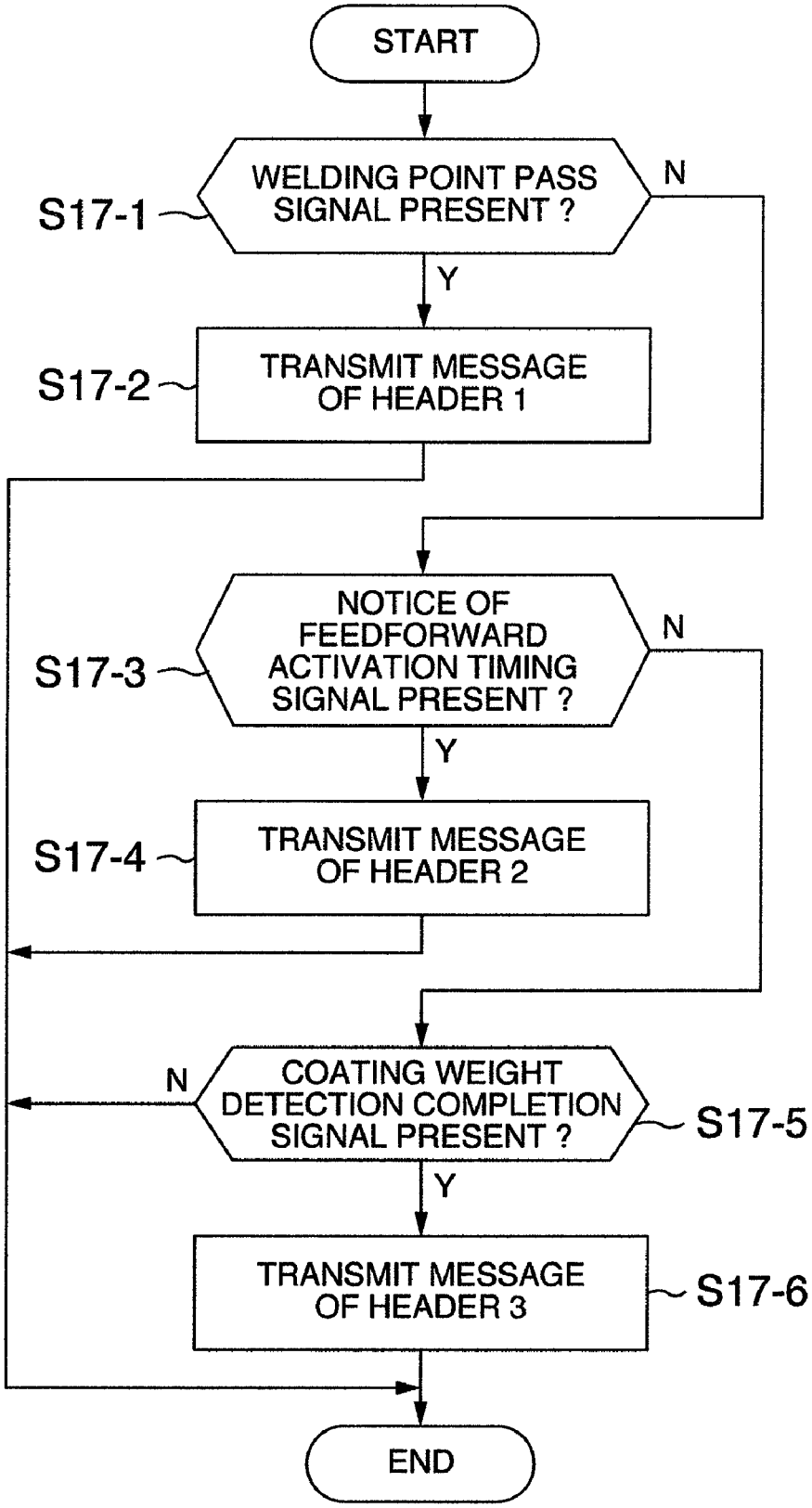
FIG. 17 is a flow chart illustrating the operation of a task activation unit according to the second embodiment.

FIG. 17 illustrates the operation to be executed by the transmission timing generation unit 1502. The transmission timing generation unit 1502 is input with an activation timing notice signal from the forward timing generation unit 1501, in addition to the coating weight detection completion signal from the input unit 131 and the welding point pass signal from the tracking unit 133. By using these signals, the transmission information editing unit 132 outputs a signal for setting the type and timing of information to be transmitted to the coating weight control apparatus 100.

It is judged at S17-1 whether there is the welding point pass signal from the tracking unit 133. If the welding point pass signal is input, a message of the header 1 is transmitted to the coating weight control apparatus 100 at S17-2. If the welding point pass signal is not input, it is judged at S17-3 whether there is a notice of the feedforward activation timing signal. If there is a notice, a message of the header 2 is transmitted to the coating weight control apparatus 100 at S17-4. At the time different from a period activation time, it is judged at S17-5 whether the coating weight detection completion signal is fetched from the input unit 131. If not, a message of the header 3 is transmitted to the coating weight control apparatus 100 at S17-6.

In the second embodiment, the message of the header 2 is transmitted only if there is a possibility of a change in the operation amount by the feedforward control. Therefore, as compared to the first embodiment which transmits the message at a constant period, traffics of the network 120 can be reduced.

Third Embodiment

Next, in the third embodiment of the present invention, description will be made on the process to be executed by the tracking unit 133 when an activation timing of the preset control is changed in accordance with target coating weights of strips before and after a welding point.

For coating weight control, if an actual coating weight is smaller than a target value, the product quality is defective, whereas if an actual coating weight is larger than a target value more or less, there is no product quality problem although there is a loss of zinc raw material. Apart from this, since a response to a reference value of a nozzle pressure is about 10 seconds, if a pressure reference is changed at a timing of welding point pass, there is no problem if a coating target value changes from thick coating to thin coating, whereas there is a problem if a coating target value changes from thin coating to thick coating. Namely, in a thick coating strip, a coating weight becomes thinner than the target value in the strip start portion where the pressure does not reach the reference value.

In order to solve this problem, the third embodiment pays attention to a change in a coating target value. When the target value is changed from thin coating to thick coating, an activation timing for the preset control is generated at a timing before welding point pass, by considering the pressure response.

Figure 18:
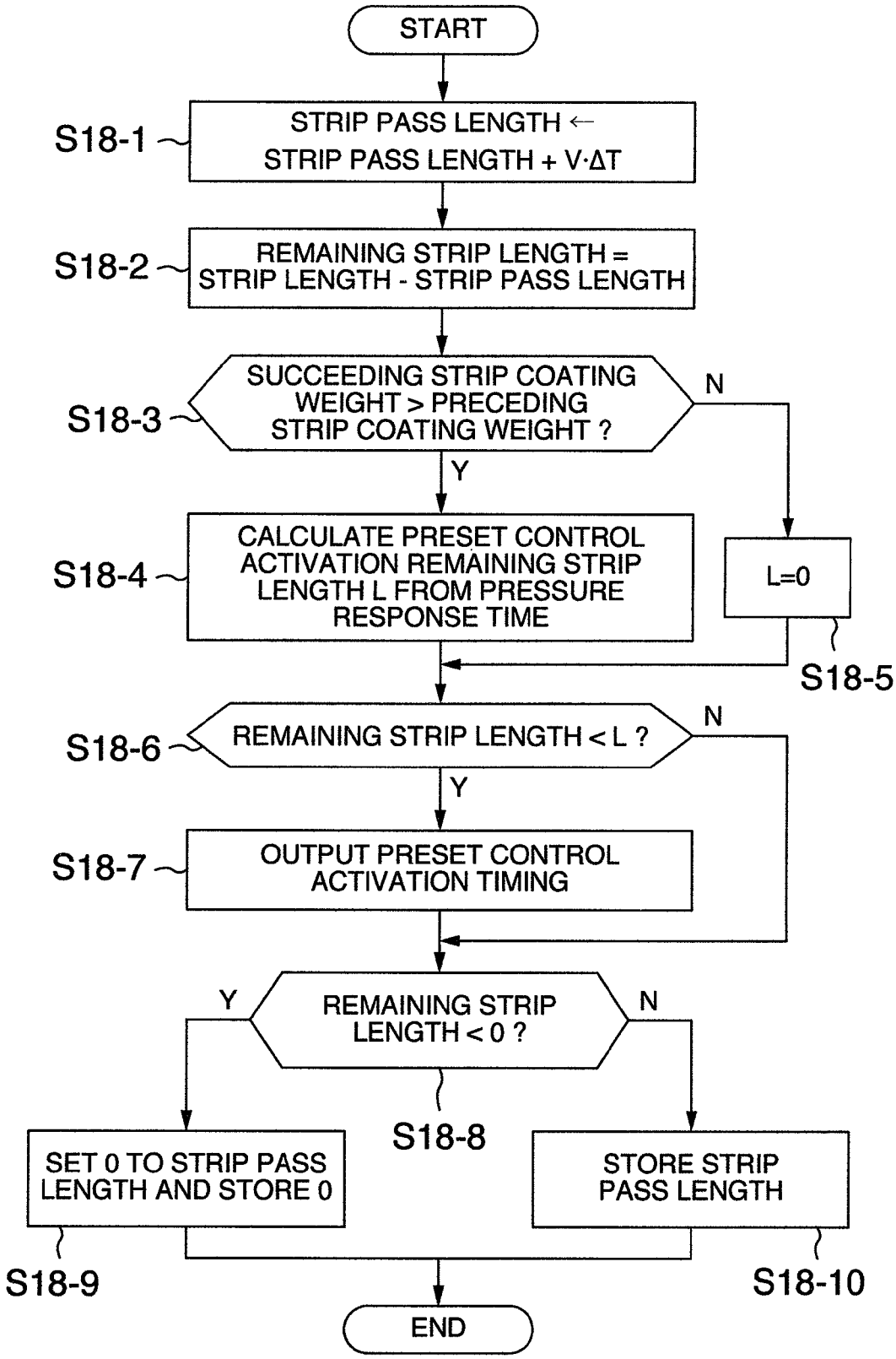
FIG. 18 is a flow chart illustrating the operation of a tracking unit according to a third embodiment.

FIG. 18 illustrates the process to be executed by the tracking unit. A strip pass length at the position of the nozzle 153 is updated at S18-1. In S18-1, V represents a strip speed, and ΔT represents a period of executing the tracking unit. A remaining strip length is calculated at S18-2 by subtracting the strip pass length from the strip length. At S18-3, a target coating weight of the succeeding strip is compared with a target coating weight of the preceding strip. If the target coating weight of the succeeding strip is larger than the target coating weight of the preceding strip, a remaining strip length L corresponding to the timing when the preset control is activated is calculated from a formula (8):

$$L = V \times \mathrm{Tp} \tag{8}$$

where Tp is a response time of a nozzle pressure.

If the target coating weight of the succeeding strip is not larger than the target coating weight of the preceding strip, L=0 is set at S18-5 because the timing when the preset control is activated corresponds to the welding point. The remaining strip length is compared with L in the formula (8) at S18-6. If the remaining strip length is shorter than L, the preset control activation timing signal is output at S18-7, whereas if the remaining strip length is not shorter than L, the preset control activation timing signal is not output. It is judged at S18-8 whether the remaining strip length is shorter than 0. If shorter, the strip pass length is set to 0 and stored at S18-9. If not shorter, since the strip continues, the strip pass length is stored at S18-10 for the next processing.

Fourth Embodiment

In the fourth embodiment, a plant maker provides services of remotely tuning the control model represented by the formula (1) via the Internet.

Figure 19:
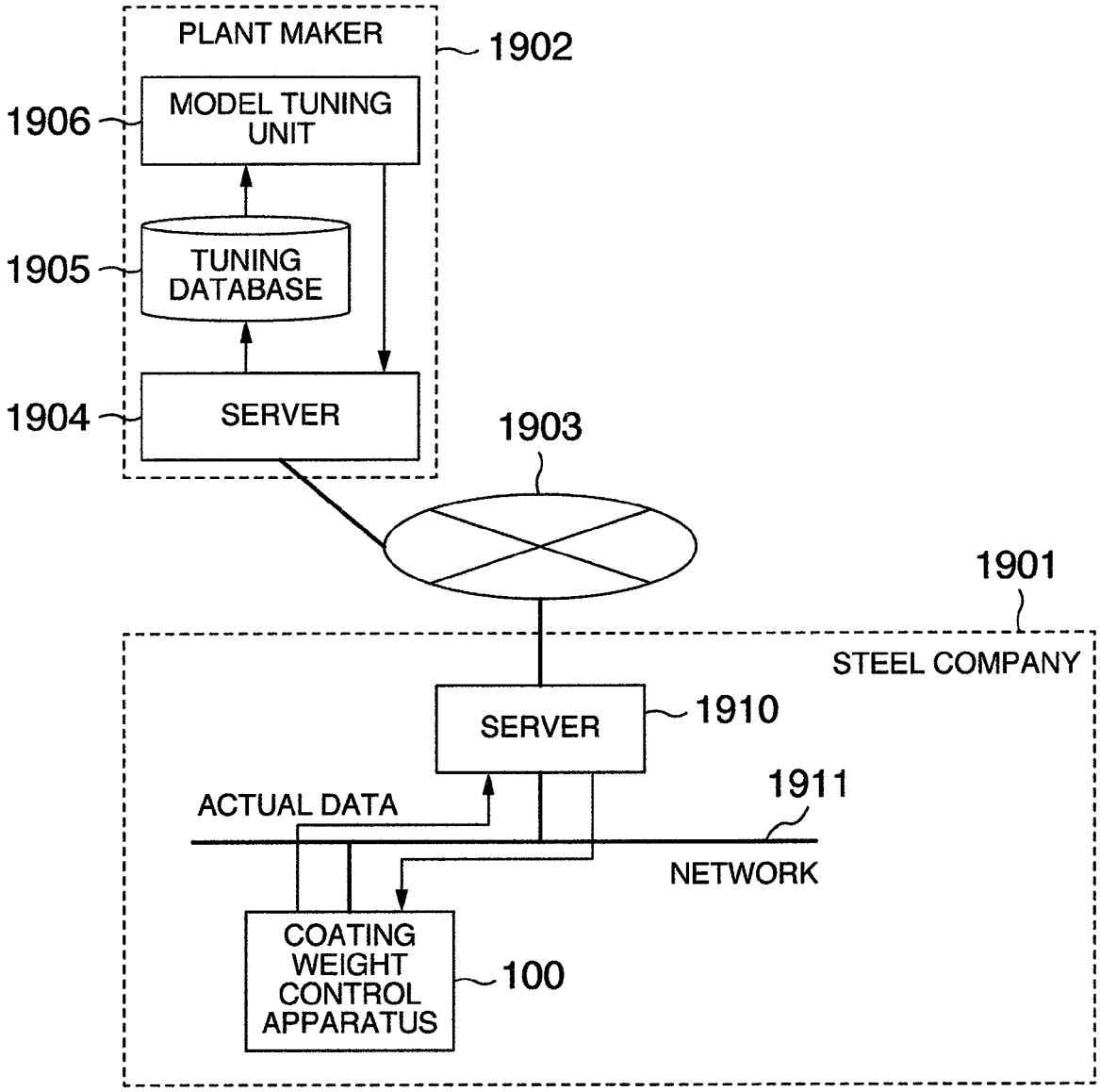
FIG. 19 is a diagram showing the configuration of remote adjustment of a control model according to a fourth embodiment.

FIG. 19 shows the whole configuration of an embodiment system. A plant maker 1902 fetches, in its server 1904 via a network 1911, a server 1910 and a network 1903, an actual value of a coating weight, associated nozzle pressure, gap and sheet speed, and primary information such as a sheet thickness and a sheet width, respectively fetched by the coating weight control apparatus 100 from the control object 150. The fetched data is stored in a tuning database 1905. The maker 1902 has a model tuning unit 1906. In response to a request from a steel company 1901, the plant maker 1902 calculates a0 to a3 in the formula (1) by using the data stored in the tuning database 1905, and transmits the calculation results to the steel company 1901. The calculations for determining a0 to a3 may be linear multiple regression. Other various methods are known, one example of which is shown, for example, in "Architecture and Training Algorithm of the Adjusting Neural Network for Accurate Model Tuning", by Yoichi Sugita, et al., Transaction of IEE of Japan, Vol. 115-D, No. 4. Compensation for model tuning may be based upon the number of tuning times, or may be a reward for success basing upon the control results improved by tuning.

The present invention described above can be widely adopted for coating weight control in steel strip process lines.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A coating weight control system comprising:

a coating weight control apparatus for calculating an operation amount for a thickness of coating to be attached to a strip; and a device control apparatus for exchanging signals with coating weight control devices to directly control the devices, and for transmitting/receiving signals via a network to/from said coating weight control apparatus, wherein said device control apparatus includes a transmission timing generation unit for generating an activation signal at a strip welding point pass timing, a coating weight measurement end timing and a predetermined period timing, to activate a corresponding coating weight control calculation of said coating weight control apparatus in accordance with the type of the activation signal.

2. The coating weight control system according to claim 1, wherein said coating weight control calculation includes preset control, feedforward control and feedback control respectively for a coating weight, which are activated at the strip welding point pass timing, the predetermined period timing, and a coating weight width-direction measurement end timing, respectively.

3. The coating weight control system according to claim 2, wherein a priority order of activation timings to be generated said device control apparatus is in the order of the preset control, the feedforward control and the feedback control respectively for the coating weight.

4. A coating weight control system comprising:

a coating weight control apparatus for calculating an operation amount for a thickness of coating to be attached to a strip; and a device control apparatus for exchanging signals with coating weight control devices to directly control the devices, and for transmitting/receiving signals via a network to/from said coating weight control apparatus, wherein:

said device control apparatus comprises transmission information editing unit for fetching signals exchanged with the coating weight control devices and editing edition information to be transmitted to said coating weight control apparatus and a transmission timing generation unit for determining a timing when the edition information is transmitted to said coating weight control apparatus, in accordance with a type of a coating weight control calculation;

said coating weight control apparatus includes a preset control calculation for determining the operation amount realizing a desired coating thickness by using a control model predicting a coating weight, a feedforward control calculation for calculating a compensation amount for the operation amount cancelling influence of a state change of the coating weight control devices, and a feedback control calculation for removing a difference between a target coating weight and a detection value by a coating weight gauge which is one of the coating weight control devices; and said transmission timing generation unit transmits the edition information corresponding to said preset control calculation at a target coating weight change timing, transmits the edition information corresponding to said feedforward control calculation at a predetermined period, and transmits the edition information corresponding to said feedback control calculation when a coating weight detection completion signal is received representing that the coating weight gauge has completed once scan measurement of a strip in a width direction.

5. The coating weight control system according to claim 4, wherein said transmission timing generation unit transmits the edition information corresponding said preset control calculation at a timing advancing the target coating weight change timing by a response time of the operation amount, only if the target coating weight is changed from thin coating to thick coating, and in other cases, transmits the edition information corresponding to the preset control calculation at the target coating weight change timing.

6. The coating weight control system according to claim 4, wherein said transmission timing generation unit detects a presence/absence of a state change of the coating weight control devices or a strip speed change, and only at a change timing, transmits the edition information corresponding to said feedforward control calculation.

* * * * *